US007185886B2

(12) United States Patent
Tamura

(10) Patent No.: US 7,185,886 B2
(45) Date of Patent: Mar. 6, 2007

(54) SHEET DELIVERY DEVICE OF A SHEET-FED PRESS

(75) Inventor: Kenyu Tamura, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 359 days.

(21) Appl. No.: 10/809,426

(22) Filed: Mar. 26, 2004

(65) Prior Publication Data

US 2004/0188926 A1 Sep. 30, 2004

(30) Foreign Application Priority Data

Mar. 28, 2003 (JP) ..... 2003-089902

(51) Int. Cl.
*B65H 31/12* (2006.01)

(52) U.S. Cl. ..... 271/218; 414/790.8

(58) Field of Classification Search ..... 271/207, 271/218; 414/790.8; 270/59, 58.31; 101/240, 101/407.1, 474
See application file for complete search history.

(56) References Cited

U.S. PATENT DOCUMENTS

| | | | | |
|---|---|---|---|---|
| 2,795,420 | A * | 6/1957 | Rooney, Jr. | 271/218 |
| 3,881,722 | A * | 5/1975 | Preuss | 271/218 |
| 3,960,374 | A * | 6/1976 | Gaffney | 271/189 |
| 3,966,196 | A | 6/1976 | Simeth | |
| 4,359,218 | A | 11/1982 | Karis | |
| 4,452,442 | A * | 6/1984 | Geschwindner et al. | 271/204 |
| 5,102,117 | A | 4/1992 | Henn et al. | |
| 5,713,283 | A | 2/1998 | Eltner et al. | |
| 5,915,688 | A * | 6/1999 | Klenk et al. | 271/218 |
| 6,776,411 | B2 * | 8/2004 | Klenk | 271/218 |
| 6,978,996 | B2 * | 12/2005 | Strauss et al. | 271/213 |

FOREIGN PATENT DOCUMENTS

| | | |
|---|---|---|
| DE | 4244384 A1 | 7/1994 |
| JP | 6-27800 | 4/1994 |
| JP | 8-507031 | 7/1996 |
| JP | 8-310712 | 11/1996 |
| JP | 9-309660 | 12/1997 |
| JP | 2768664 | 4/1998 |

OTHER PUBLICATIONS

Catalogue of Non-Stop Cutain System by MMT Manufacturing Corp., Apr. 17, 2003, http://ebiz.netopia.com/mmtsales/nonstopcurtainsystem.

* cited by examiner

*Primary Examiner*—David H. Bollinger
(74) *Attorney, Agent, or Firm*—Wenderoth, Lind, & Ponack, L.L.P.

(57) ABSTRACT

A sheet delivery device for a sheet-fed press which is arranged to avoid the crushing of sheets, comprises a shutter device having a shutter bar unit that is movable between an operation position and a stand-by position. In the operation position the shutter bar unit is arranged to provisionally receive the printed sheets conveyed from the sheet conveyor. This sheet delivery device also comprises a sheet separating device having an operation position and a stand-by position and includes a belt-like blade. In the operation position the belt-like blade is arranged over an entire width of the stacked sheets and above an end portion of the stacked sheets from which the shutter bar unit enters the operation position. Thus, when in the operation position, the sheet separating device is arranged to create a separation into which the shutter bar unit is to be inserted, and to subsequently receive the printed sheets.

17 Claims, 9 Drawing Sheets

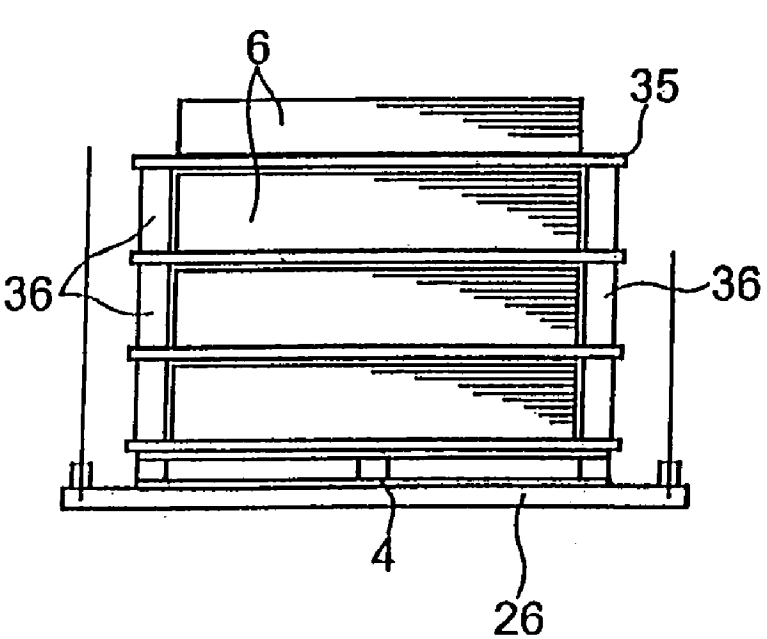
Fig. 8 (b) (Prior art)
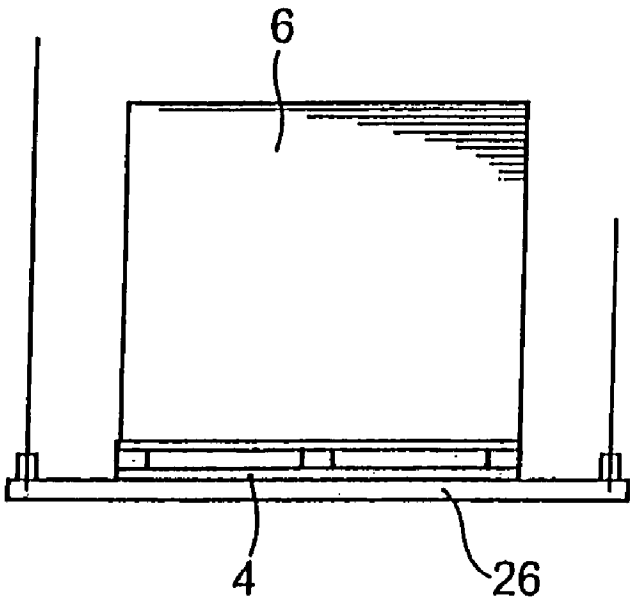
Fig. 8 (a) (Prior art)

Fig. 9 (a) (Prior art)
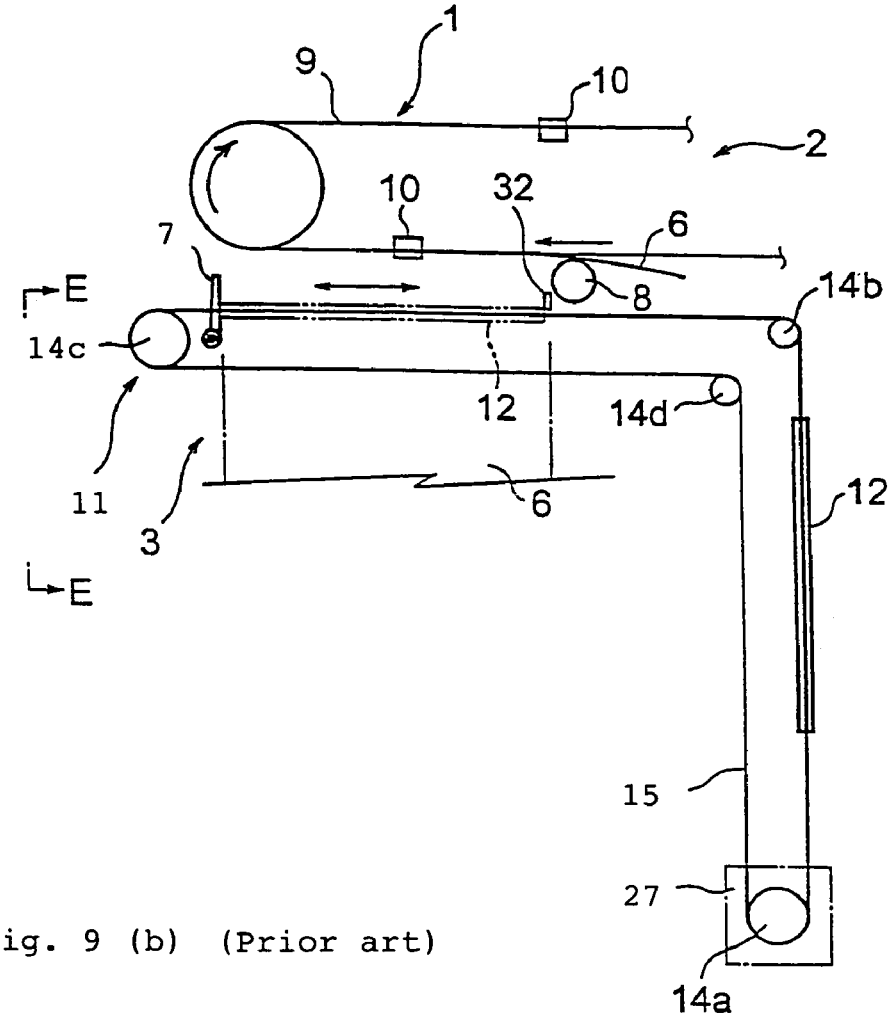
Fig. 9 (b) (Prior art)
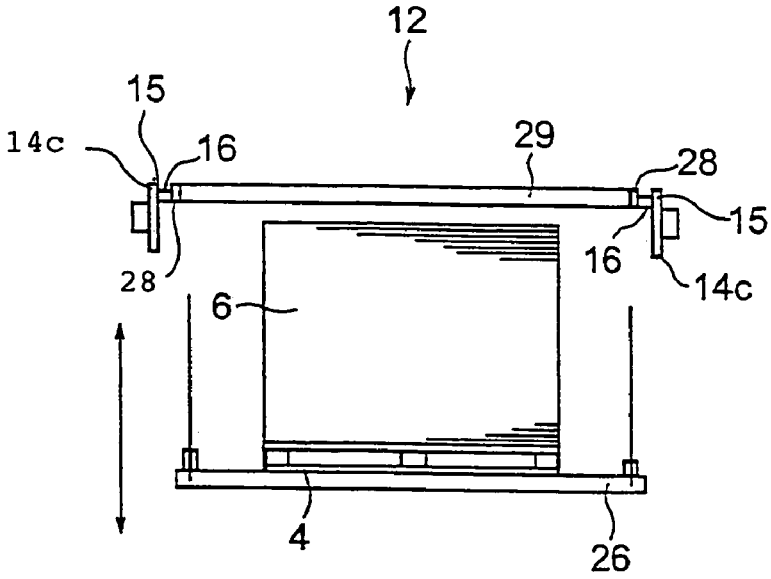

SHEET DELIVERY DEVICE OF A SHEET-FED PRESS

BACKGROUND OF THE INVENTION

1. Field of the Invention

The present invention relates to a sheet delivery device of a sheet-fed press of the type that sheets being conveyed to a sheet stacker portion from a printing machine portion are provisionally received so that the sheets can be stably and continuously stacked.

2. Description of the Prior Art

With reference to FIGS. 7 and 8, a sheet delivery device of a general sheet-fed press in the prior art will be described. Also, with reference to FIGS. 9 and 10, a sheet stacker portion as a main part of the sheet delivery device will be described.

FIG. 7 is a schematic entire construction explanatory view of one example of a prior art sheet-fed press. FIG. 8 is an explanatory view of a prior art sheet stacking method and comprises FIGS. 8(*a*) and 8(*b*), wherein FIG. 8(*a*) is of a continuous stacking system and FIG. 8(*b*) is of a divided stacking system. FIG. 9 is an explanatory view of the continuous stacking system of FIG. 8(*a*) and comprises FIGS. 9(*a*) and 9(*b*), wherein FIG. 9(*a*) is a construction explanatory side view of main portions thereof and FIG. 9(*b*) is a view seen from arrows E—E of FIG. 9(*a*). FIG. 10 is an explanatory view of the divided stacking system of FIG. 8(*b*) and comprises FIGS. 10(*a*) and 10(*b*), wherein FIG. 10(*a*) is a construction explanatory side view of main portions thereof and FIG. 10(*b*) is a view seen from arrows F—F of FIG. 10(*a*).

While there are various types of the sheet-fed press, the example shown in FIG. 7 is constructed by such main devices and portions (constructing elements) as a sheet feeder 20, printing machine 17, sheet delivery device 1 portion, etc. The sheet delivery device 1 portion comprises a sheet conveyor 2 and sheet stacker 3.

Functions of the respective devices and portions will be briefly described. The sheet feeder 20 is a device that has sheets 6 to be printed stacked on a sheet feeding table 21 and supplies the sheets 6 one after another into the printing machine 17 as the next step.

The printing machine 17 comprises a plurality of printing devices (17*a* to 17*d*), arrayed in parallel to each other, in the number corresponding to the kinds of inks, such as of black, blue, red, yellow or other specific colors, as needed. While the sheets 6 supplied one after another from the sheet feeder 20 are being sequentially conveyed downstream via claw-like members provided on impression cylinders 18 (18*a* to 18*d*) and intermediate cylinders 22, the inks of the necessary colors are transferred onto the sheets 6. That is, in each of the printing devices, the ink of a necessary quantity is prepared by an inking device to be supplied onto a press plate 24 fitted to a plate cylinder 23. The ink transferred onto picture or letter portions of the press plate 24 is further transferred onto a rubber cylinder 25 and the ink on the outer circumferential surface of the rubber cylinder 25 is transferred onto each of the sheets 6 that is being conveyed between the rubber cylinder 25 and the impression cylinder 18. It is to be noted that the illustration of FIG. 7 shows an example of the sheet-fed press constructed having four printing devices 17*a* to 17*d* on the upper side of the sheet path line so that printing of four colors can be carried out on the surface of each of the sheets 6 and the number of the printing devices can be variously set.

The sheets 6 on which the first color has been printed at the first press device 17*a* are conveyed to the first intermediate cylinder 22 from the first impression cylinder 18*a* to be received on the second impression cylinder 18*b* of the second printing device 17*b*. Then, the sheets 6 pass through the third and fourth (last) printing devices 17*c*, 17*d* and the aimed multi-color printing is completed.

The sheets 6 on which a predetermined printing has been completed are conveyed to the downstream sheet delivery device 1 portion from the impression cylinder 18*d* of the last printing device 17*d* by the sheet conveyor 2. The sheet conveyor 2 comprises an endless chain 9 that runs being wound around a sheet delivery axle 19 and a chain gripper 10 is provided on the endless chain 9. The printed sheets 6 are received to be held by the chain gripper 10 and are conveyed in this state. Above a sheet delivery table 26, and at an appropriate position (timing) in the sheet running direction, the sheets 6 are released from the chain gripper 10 by a sheet release cam (not shown) and fall down one after another on a pallet 4 placed on the sheet delivery table 26 to be stacked thereon.

At this time, front ends of the printed sheets 6 conveyed by the sheet conveyor 2 abut on a front abutting member 7 provided on the downstream upper side of the sheet stacker 3 portion so that the front ends of the sheets 6 are arrayed and in this state, the sheets 6 are stacked on the pallet 4 placed on the sheet delivery table 26 of the sheet stacker 3. When the sheets 6 begin to fall down as mentioned above, their running velocity is controlled to be retarded so that damage of the sheets caused by a violent collision with the front abutting member 7 can be avoided. As a means to control the velocity of the sheets 6, a vacuum suction roller 8 is provided on an inlet upper portion of the sheet stacker 3.

This vacuum suction roller 8 is constructed having an outer roller and being supported on a frame by bearings to be rotatably driven by an independent motor (not shown) or by being connected to the printing machine portion and has an entire outer circumferential surface of the outer roller provided with a plurality of suction holes bored along the circumferential direction. The vacuum suction roller 8 is operated such that the circumferential velocity thereof is sufficiently slower than the running velocity of the sheets 6. Thus, when the sheets 6 being conveyed run on a plate-like sheet guide 5 provided below the sheet conveyor 2, their velocity is retarded by the vacuum suction roller 8 and hence the sheets 6 fall down on the sheet delivery table 26 in the state that the velocity is reduced.

The sheet delivery table 26 is controlled to be lowered corresponding to the stacked thickness of the falling sheets 6 so that the falling distance of the sheets 6 is maintained approximately constant. When a predetermined number of the sheets 6 are stacked on the pallet 4 so that a predetermined stacking condition is achieved, the pallet 4 together with the stacked sheets 6 is taken out to be conveyed outside and a vacant pallet 4 for replacement is placed on the sheet delivery table 26.

As a sheet stacking method carried out by the sheet stacker 3, there are typically a continuous stacking system shown in FIG. 8(*a*) and a divided stacking system shown in FIG. 8(*b*). In the continuous stacking system, the falling sheets 6 are continuously stacked without interruption to form a bundle of a predetermined number of sheets. This system is often employed when there are sheets of thick paper or there is printing having little ink transfer on the sheet back side.

In the continuous stacking system, as shown in FIGS. 9(*a*) and 9(*b*), the sheets 6 are continuously fed onto the pallet 4 placed on the sheet delivery table 26 until a predetermined number of the sheets 6 are stacked. When stacking of the predetermined number of the sheets 6 is attained, a shutter bar unit 12 of a shutter device 11 that has been on a stand-by position is moved and quickly inserted between the falling sheets 6 so that the subsequent sheets 6 are provisionally received on the shutter bar unit 12 and thus the sheets 6 are separated into a lower portion of the stacked sheets and an upper portion of the sheets to be subsequently stacked.

The shutter device 11 has two endless chains 15 provided on both sides of the sheet delivery table 26. These endless chains 15, as shown in FIGS. 9(*a*) and 9(*b*), are wound around a plurality of sets of sprockets 14*a* to 14*d* fitted to frames of both sides of the sheet delivery device 1 portion so as to run along the sheet conveying direction of the sheet conveyor 2. The shutter bar unit 12 comprises a plurality of roller assemblies arrayed in the running direction of the endless chains 15 and each of the roller assemblies comprises a roller 29 having its both ends rotatably supported via bearings 28 to attachments 16 fitted to predetermined portions of both of the endless chains 15.

One set of the sprockets 14*a* is connected to a reversible motor 27 and by the drive of the motor 27, the shutter bar unit 12 can be operated so as to move between the operation position [shown by double-dotted chain lines in FIG. 9(*a*)] that is above the stacked sheets 6 and below a front end portion of the sheet conveyor 2 and the stand-by position [shown by solid lines in FIG. 9(*a*)] that is apart from the operation position.

As mentioned above, after the sheets 6 are provisionally received to be separated by the shutter bar unit 12 at the operation position, the sheet delivery table 26 is lowered to stop at the lowermost position and the bundle of the stacked sheets 6 together with the pallet 4 is discharged outside. Then, the sheet delivery table 26 on which another new pallet 4 is placed for replacement is lifted to stop at a predetermined height. A sheet stopper 32 is operated so as to regulate rear ends of the sheets 6 and at the same time, the shutter bar unit 12 is retreated to the stand-by position so that the provisionally received sheets 6 are placed on the pallet 4. Thereafter, the sheet delivery table 26 is lowered corresponding to the thickness of the falling sheets 6 and the sheets 6 are stacked one after another on the pallet 4.

On the other hand, in the divided stacking system shown in FIG. 8(*b*), a partition plate 35 is inserted between the sheets 6 above the pallet 4 so that the sheets 6 are separated into bundles of the stacked sheets, wherein each of the bundles contains a predetermined number of the sheets 6 and is stacked one on another with a predetermined gap being maintained between the partition plate 35 and an upper surface of the bundle, as will be described below. This system is often employed when of sheets of thin paper are used or the printing is liable to cause ink transfer on the back-side of the sheet, since the load of the weight of the stacked sheets 6 can be separated into smaller units.

In the divided stacking system, as shown by a sheet stacker 3' of FIGS. 10(*a*) and 10(*b*), there is provided a plate receiving device 33 comprising rails 34*a*, 34*b*. While the conveyed sheets 6 are falling down in operation, the sheet delivery table 26 is lowered to a predetermined position and the partition plate 35 is quickly moved on the rails 34*a*, 34*b* so as to be inserted between the falling sheets 6 and the stacked sheets 6 on the sheet delivery table 26 portion. Thereby, the sheets 6 are separated into a lower bundle of the stacked sheets 6 and an upper portion of the subsequent sheets 6 to be stacked.

The two rails 34*a*, 34*b* of the plate receiving device 33 are provided in parallel to the sheet conveying direction of the sheet conveyor 2 above both sides of the sheet delivery table 26, pallet 4, partition plate 35 and stacked sheets 6 and are constructed to be moveable in a back and forth direction to a center of the sheet delivery table 26 so that a distance between the rails 34*a*, 34*b* is changeable.

After the (new) partition plate 35 is so inserted between the sheets 6, blocks 36 are put in between four corner portions of the new partition plate 35 and those of the previous partition plate 35. The sheet delivery table 26 is slightly lifted and the rails 34*a*, 34*b* are moved toward outside in the width direction of the sheet conveyor 2 so that the new partition plate 35 is completely supported by the blocks 36 resting on the previous partition plate 35. The height of the blocks 36 is set to be slightly higher than the thickness of the stacked sheets 6 so that a gap d is formed between a lower surface of the partition plate 35 supported by the blocks 36 and an upper surface of the stacked sheets 6. Thereafter, the same operation is repeated and bundles of the sheets in which each bundle has a predetermined number of sheets are sequentially formed.

While the conveyed sheets 6 continue to fall down, when the total weight of the stacked sheets 6 on the sheet delivery table 26 reaches a predetermined level, the sheet delivery table 26 is slightly lowered and the partition plate 35 is inserted between the sheets 6 at a high velocity. Thereby, the sheets 6 are separated into the upper bundle supported by the new partition plate 35 and the lower bundles supported by the previous partition plates 35. Then, the sheet delivery table 26 is lowered to the lowermost position to stop there and the bundles of the stacked sheets 6 together with the pallet 4 are discharged outside.

Then, the sheet delivery table 26 is lifted to a predetermined height position to stop there, the pallet 4 is placed on the sheet delivery table 26 and the rails 34*a*, 34*b* are moved aside. The sheet delivery table 26 is lowered corresponding to the thickness of the sheets 6 being stacked and thus the predetermined number of the sheets 6 are stacked on the pallet 4. Thereafter, the above-mentioned operations are sequentially repeated.

In the prior art sheet delivery device 1 of a sheet-fed press, while the sheet stacker 3 is constructed to function as mentioned above, there are structural shortcomings, as mentioned next, in the case of the continuous stacking system shown in FIGS. 9(*a*) and 9(*b*):

(1) As the shutter bar unit 12 is inserted between the stacked sheets 6 and the sheets 6 that are being conveyed at a high velocity, there is a risk that the falling sheets 6 are crushed by the shutter bar unit 12.

(2) Unless the crushed sheets (spoilage) 6 are immediately removed, there is caused an obstacle in stacking the subsequent sheets 6. But the removing work thereof accompanies dangers because there are nearby rotating machines and devices. Also, stacking (jogging) of the falling sheets 6 may be affected by the removing work.

(3) While the shutter bar unit 12 is being operated, the velocity of the printing must be lowered and this remarkably deteriorates the production efficiency.

In order to overcome the above-mentioned shortcomings, while there are proposed such a structure that the drive mechanism of the shutter bar unit 12 is improved to elevate the moving velocity (the Japanese patent laid-open application Hei 9-309660, page 2, FIGS. 1 and 2, for example), etc., there are still problems in the complicated structure of the stacker, etc.

In the case of the divided stacking system shown in FIGS. 10(*a*) and 10(*b*) also, like the continuous stacking system, there are structural shortcomings as follows:

(1) As the partition plate 35 must be quickly inserted between the stacked sheets 6 and the sheets 6 that are being conveyed to fall down at a high velocity, there is a risk that the falling sheets 6 are crushed by the partition plate 35.

(2) Unless the crushed sheets (spoilage) 6 are immediately removed, there is caused an obstacle in stacking the subsequent sheets 6. But the removing work thereof accompanies dangers because there are nearby rotating machines and devices. Also, stacking (jogging) of the falling sheets 6 may be affected by the removing work.

(3) While the partition plate 35 is being inserted, the velocity of the printing must be lowered and this remarkably deteriorates the production efficiency.

Also, as a common problem for both systems, highly skilled operators are needed. Further, in the prior art sheet delivery device 1 portion, there is disclosed no such device yet as having both of the shutter device 11 as shown in FIGS. 9(*a*) and 9(*b*) and the plate receiving device 33 as shown in FIGS. 10(*a*) and 10(*b*). That is, in the prior art sheet delivery device 1, the shutter device 11 is provided only in a press exclusive for the continuous stacking system and no shutter device 11 is used yet for the divided stacking system.

SUMMARY OF THE INVENTION

It is therefore an object of the present invention to provide a sheet delivery device that solves the above-mentioned problems in the prior art sheet delivery device of a sheet-fed press by improving the sheet delivery device such that crushing of the falling sheets is avoided, stacking quality of the sheets is enhanced, production efficiency is enhanced without need of reduction of the printing velocity and operation is simplified.

In order to achieve the above-mentioned object, the present invention provides a sheet delivery device of a sheet-fed press constructed by the means as follows:

(1) As a first means, a sheet delivery device of a sheet-fed press of the type that printed sheets conveyed by a sheet conveyor are sequentially stacked on a pallet placed on an upward and downward movable sheet delivery table and the pallet having the printed sheets stacked thereon in a predetermined stack state is taken out together with so stacked sheets and is replaced with a vacant pallet is characterized in that the sheet delivery device comprises a shutter device and a sheet separating device. The shutter device comprises a shutter bar unit movable between an operation position arranged between the stacked sheets and the sheet conveyor and a stand-by position arranged apart from the operation position to provisionally receive at the operation position the printed sheets conveyed from the sheet conveyor. Also, the sheet separating device comprises a belt-like blade movable over an entire width of the stacked sheets in the direction orthogonal to a moving direction of the shutter bar unit along an upper surface position of the shutter bar unit above an end portion of the stacked sheets from which the shutter bar unit enters the operation position.

According to the first means constructed as mentioned above, the shutter bar unit is inserted between the stacked sheets and the subsequent sheets of which rear ends are lifted and supported by the blade. Thereby, such a phenomenon that the falling sheets are crushed from their rear end by the shutter bar unit can be avoided, occurrence of spoilage can be eliminated and the dangerous work to remove the spoilage becomes unnecessary and sheet stacking quality (accuracy of sheet jogging) can be largely enhanced. Also, as the insertion of the shutter bar unit can be done in the usual operating velocity without need to reduce the printing velocity, the shutter bar unit can be stably inserted. Thus, the productivity can be remarkably enhanced and highly skilled operators are not required for stacking and replacing of the sheets.

(2) As a second means, in the sheet delivery device of a sheet-fed press of the first means, the shutter bar unit is formed comprising endless chains and a plurality of roller assemblies. The endless chains are provided on both sides of the sheet delivery table in parallel to a sheet conveying direction of the sheet conveyor. The plurality of roller assemblies are arrayed in a running direction of the endless chains and comprises rollers having both ends supported by the endless chains via bearings.

According to the second means, in addition to the function of the first means, the shutter bar unit is formed by the plurality of roller assemblies comprising rollers rotatably supported by the bearings and is inserted between the stacked sheets and the subsequent sheets of which rear ends are lifted and supported by the blade. Thereby, the insertion of the shutter bar unit can be carried out with less resistance.

Also, as a third means, in the sheet delivery device of a sheet-fed press of the first or second means, a plate receiving device is provided comprising rails arranged in parallel to the sheet conveying direction of the sheet conveyor on both sides of the sheet delivery table closely below the shutter bar unit at the operation position and moveable in a back and forth direction to a center of the sheet delivery table so that a distance between the rails is changeable.

According to the third means, in addition to the function of the first or second means, selection of either the continuous stacking system or of the divided stacking system becomes possible and both systems can be quickly and easily employed by switch-over. Also, in the case of the divided stacking system, the shutter bar unit is inserted after the rear end portion of the falling sheets is lifted and supported by the blade and the partition plate can be inserted below the shutter bar unit. Thereby, the insertion of the partition plate can be done at an arbitrary timing relative to the stacked sheets to be delivered and the subsequently falling sheets, the phenomenon to crush the falling sheets can be avoided so that occurrence of spoilage can be eliminated and the dangerous work to remove the spoilage becomes unnecessary. Also, as the partition plate can be inserted while the usual velocity of the printing is maintained, there is no worry that the printing quality and productivity are deteriorated and further a high skill of operators is not required for stacking and replacing of the sheets.

BRIEF DESCRIPTION OF THE DRAWINGS

FIG. 8 is an explanatory view of a prior art sheet stacking method and comprises FIGS. 8(*a*) and 8(*b*), wherein FIG. 8(*a*) is of a continuous stacking system and FIG. 8(*b*) is of a divided stacking system.

FIG. 9 is an explanatory view of the continuous stacking system of FIG. 8(*a*) and comprises FIGS. 9(*a*) and 9(*b*), wherein FIG. 9(*a*) is a construction explanatory side view of main portions thereof and FIG. 9(*b*) is a view seen from arrows E—E of FIG. 9(*a*).

DETAILED DESCRIPTION OF THE INVENTION

Figure 7:
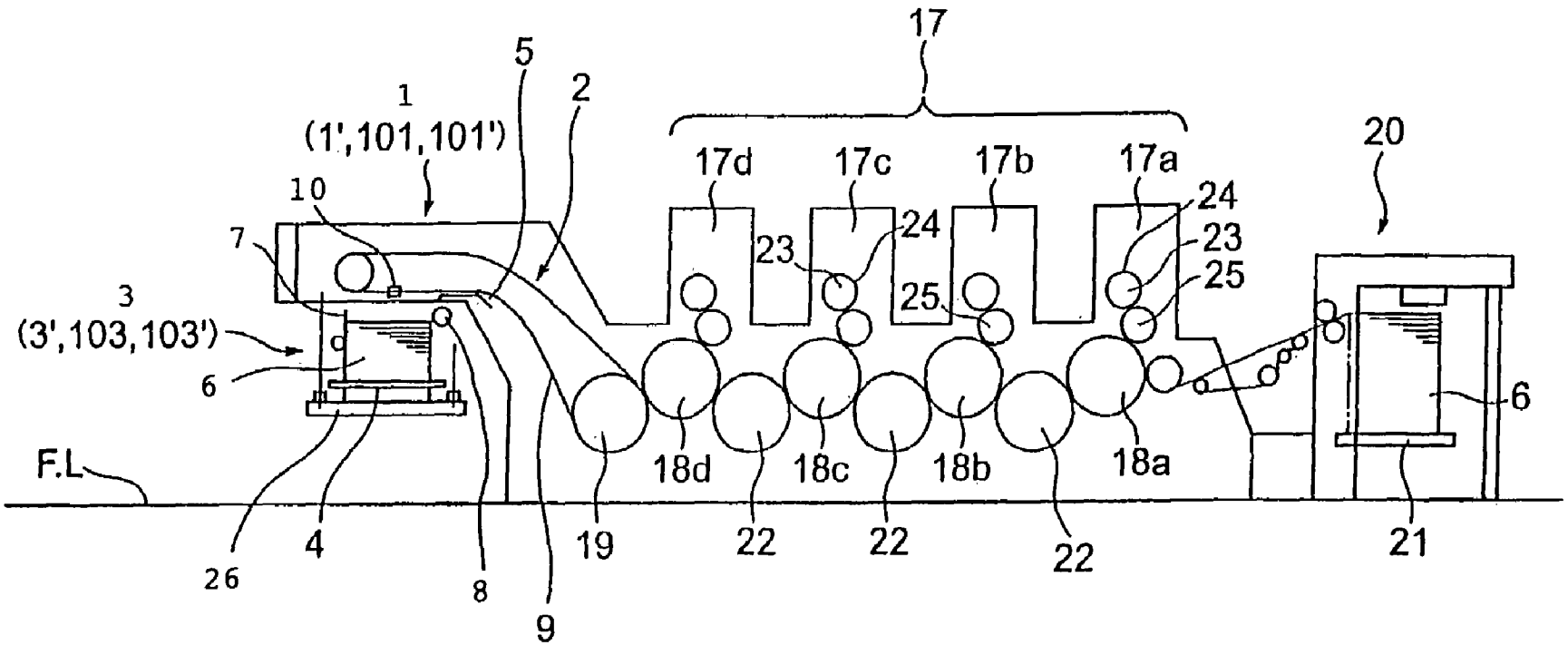
Fig. 7 (Prior art)
FIG. 7 is a schematic entire construction explanatory view of one example of a prior art sheet-fed press.
Figure 10:
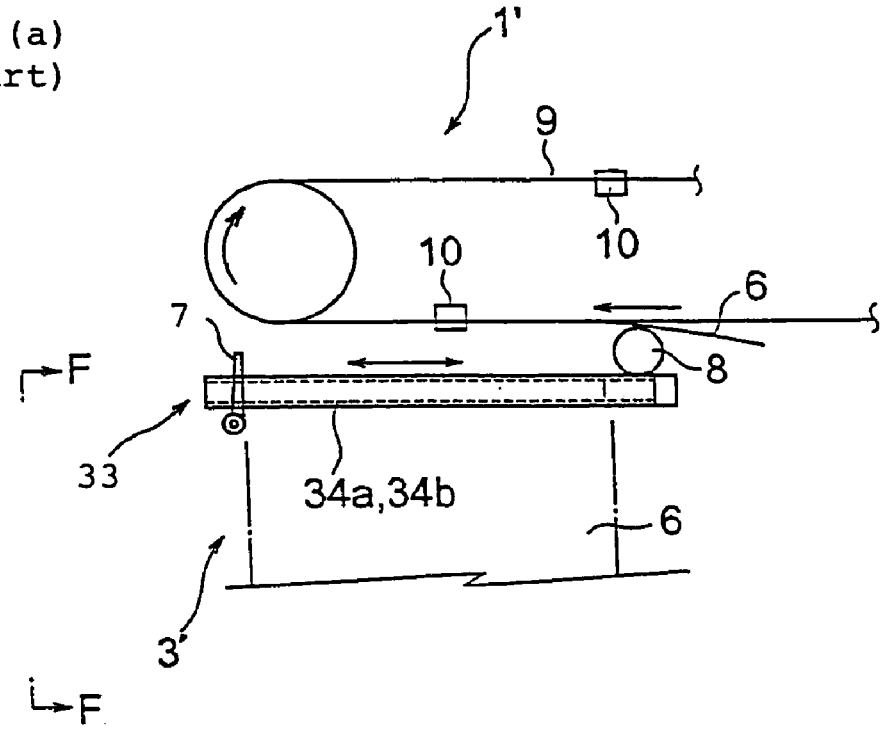
Fig. 10 (a) (Prior art)
FIG. 10 is an explanatory view of the divided stacking system of FIG. 8(*b*) and comprises FIGS. 10(*a*) and 10(*b*), wherein FIG. 10(*a*) is a construction explanatory side view of main portions thereof and FIG. 10(*b*) is a view seen from arrows F—F of FIG. 10(*a*).
Figure 10:
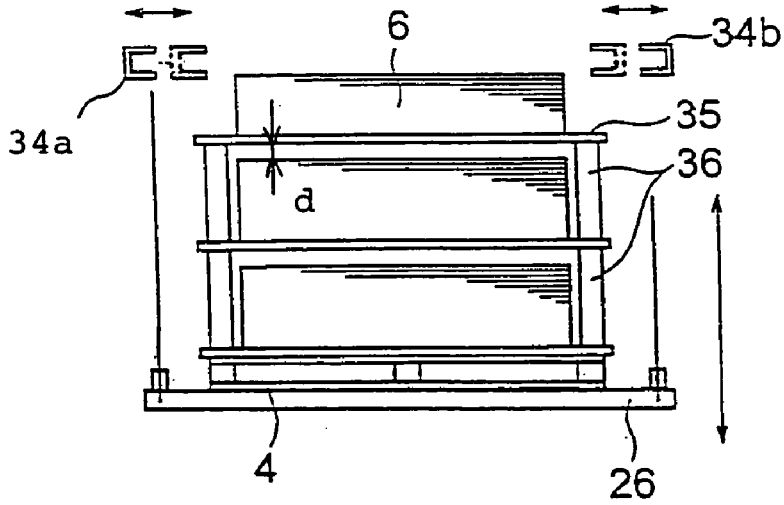
Fig. 10 (b) (Prior art)

A sheet delivery device of a sheet-fed press of a first embodiment according to the present invention will be described with reference to FIGS. 1 to 4, wherein the above described FIGS. 7 and 8 also will be referenced for description of the general constructional aspect.

Figure 1:
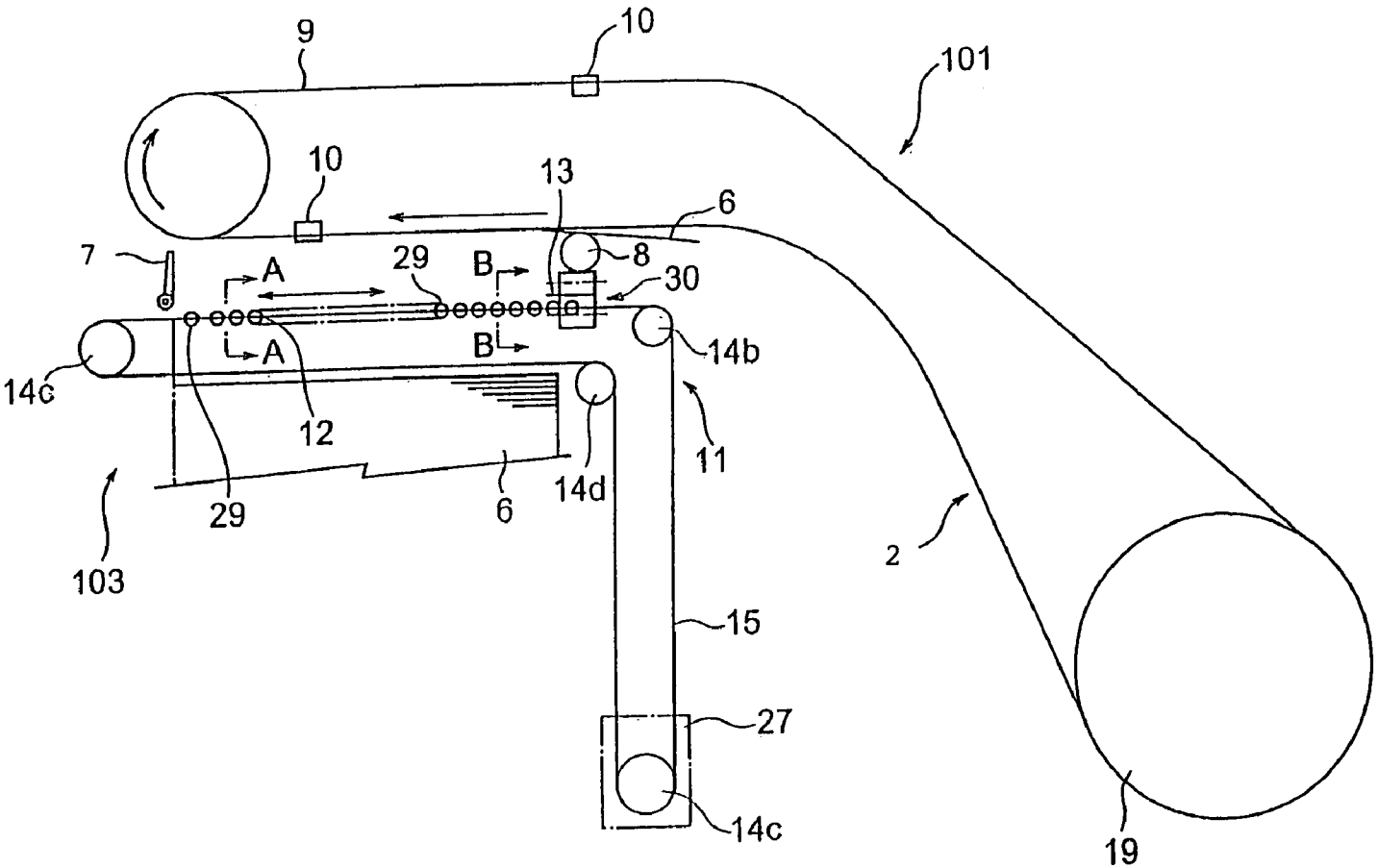
FIG. 1 is a schematic construction explanatory side view of main portions of a sheet delivery device of a sheet-fed press of a first embodiment according to the present invention.
Figure 2:
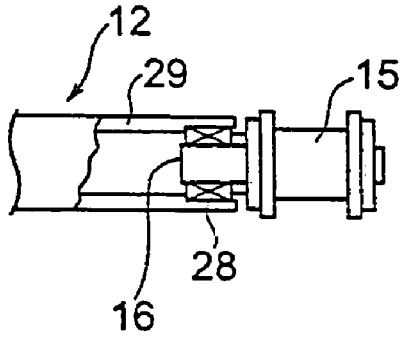
FIG. 2 is an enlarged partially cut-out view of a roller fitting portion of a shutter bar unit seen from arrows A—A of FIG. 1.
Figure 3:
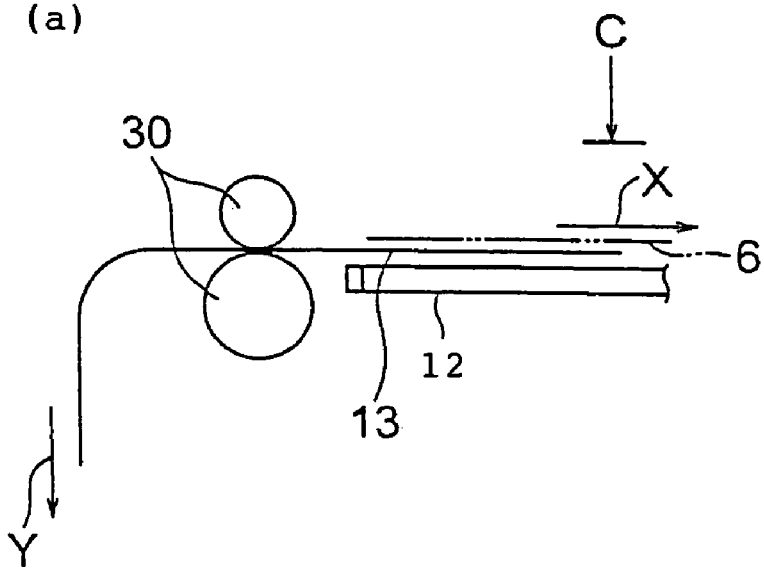
FIG. 3 comprises FIGS. 3(*a*) and 3(*b*), wherein FIG. 3(*a*) is an arrangement and operation explanatory view of a sheet separating device having a blade and a blade moving device seen from arrows B—B of FIG. 1 and FIG. 3(*b*) is a view seen from arrow C of FIG. 3(*a*).
Figure 3:
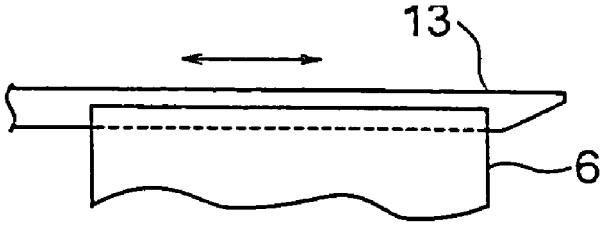
Figure 4:
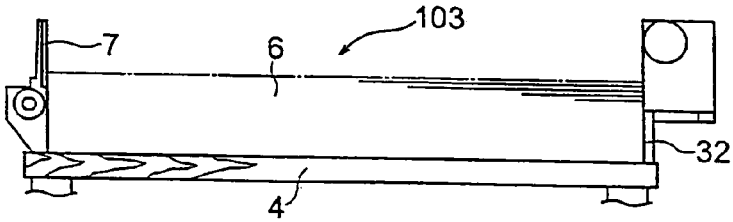
FIG. 4 comprises FIGS. 4(*a*) to 4(*f*) for explaining the operation steps of main portions of the sheet delivery device of FIG. 1.
Figure 4:
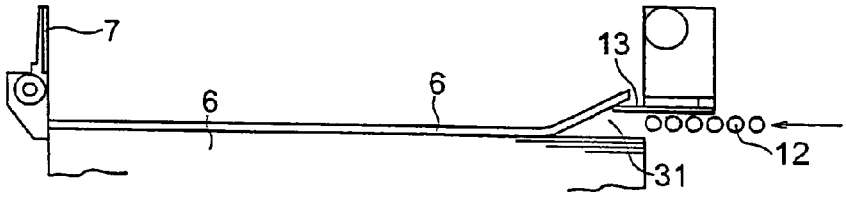
Figure 4:
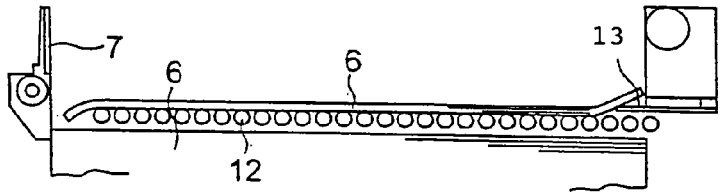
Figure 4:
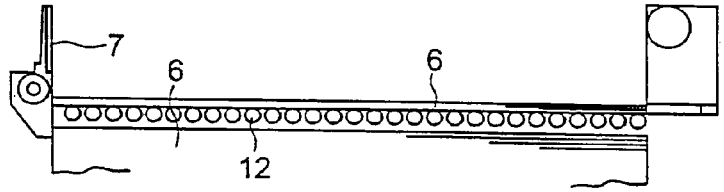
Figure 4:
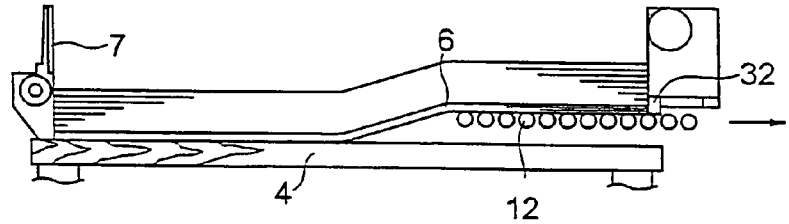
Figure 4:
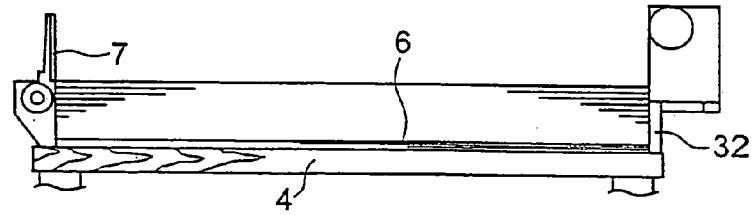

FIG. 1 is a schematic construction explanatory side view of main portions of a sheet delivery device of a sheet-fed press of the first embodiment according to the present invention. FIG. 2 is an enlarged partially cut-out view of a roller fitting portion of a shutter bar unit seen from arrows A—A of FIG. 1. FIG. 3 comprises FIGS. 3(*a*) and 3(*b*), wherein FIG. 3(*a*) is an arrangement and operation explanatory view of a sheet separating device having a blade and a blade moving device seen from arrows B—B of FIG. 1 and FIG. 3(*b*) is a view seen from arrow C of FIG. 3(*a*). FIG. 4 comprises FIGS. 4(*a*) to 4(*f*) for explaining operation steps of main portions of the sheet delivery device of FIG. 1.

In the present description of the sheet delivery device of the first embodiment, the same parts and components as those of the prior art device are designated with the same reference numerals and description thereon will be omitted. Also, the basic sequential functions of the sheet delivery device until the printed sheets are conveyed above the sheet stacker to fall down thereon are the same as those of the prior art device and those points different from the prior art device will be mainly described below.

In the sheet delivery device 101 of the present first embodiment, as shown in FIGS. 1 to 3, in addition to the shutter device 11 that is substantially the same as the prior art device, there is provided a blade 13 at a position above a sheet stacker 103 of the sheet delivery device 101 and also above an operation position or insertion position into which the shutter bar unit 12 of the shutter device 11 is inserted.

The shutter device 11, like the prior art device described above, has two endless chains 15 provided on both sides of the sheet delivery table 26. These endless chains 15 are wound around a plurality of sets of sprockets 14*a* to 14*d* fitted to frames of both sides of the sheet delivery device 1 portion so as to run along the sheet conveying direction of the sheet conveyor 2. The shutter bar unit 12 comprises a plurality of roller assemblies arrayed in the running direction of the endless chains 15 and, as shown in FIG. 2, each of the roller assemblies comprises a roller 29 having its both ends rotatably supported via bearings 28 to attachments 16 fitted to predetermined portions of both of the endless chains 15.

Also, one set of the sprockets 14*a* is likewise connected to a reversible motor 27 and by the drive of the motor 27, the shutter bar unit 12 can be operated so as to move between the operation position (insertion position) that is above the stacked sheets 6 and below the front end portion of the sheet conveyor 2 and the stand-by position that is apart from the operation position.

On the other hand, as shown in FIGS. 3(*a*) and 3(*b*), the blade 13 is a belt-like member made by a thin steel plate. The blade 13 is provided above a position where the shutter bar unit 12 begins to enter the operation position or, in the example of FIGS. 3(*a*) and 3(*b*), at a position of a rear end portion of the falling sheets 6. Also, the blade 13 has its belt-shape flat surface positioned along an upper surface plane of the shutter bar unit 12 above a rear end portion of the stacked sheets 6. The blade 13 is constructed movably over an entire transverse width of the sheets 6 in the direction orthogonal to the running direction of the shutter bar unit 12. That is, the blade 13 is movable by a blade moving device 30 between an operation position X that elongates over the entire transverse width of the sheets 6 and a stand-by position Y on one side end portion of the sheet delivery device 101. Thus, the blade 13 together with the blade moving device 30 constitutes a sheet separating device that forms a space 31 [see FIG. 4(*b*)] at the rear end portion of the sheets 6 to be stacked.

In the sheet delivery device 101 of a sheet-fed press of the present first embodiment constructed as mentioned above, the sequential functions as a sheet delivery device to convey the printed sheets 6 to fall down on the sheet delivery device are basically the same as those of the prior art device as already described. What is largely different from the functions of the prior art device will be described below with respect to the case of the continuous stacking system, by which such a function and effect as heretofore have not been seen can be obtained.

FIG. 4 comprises FIGS. 4(*a*) to 4(*f*) for explaining operation steps of main portions of the present first embodiment. In FIG. 4(*a*), when the printed sheets 6 are stacked in a predetermined quantity, the sheet delivery table 26 is lowered until the upper surface of the stacked sheets 6 comes below the operation position of the shutter bar unit 12. Then, the sheet stopper 32 is retreated and while the subsequent sheets 6 are falling down, the front end of the blade 13 is inserted into the rear end portion of the sheets 6, as shown in FIG. 4(*b*), so that the blade 13 elongates over the entire transverse width of the sheets 6.

Then, the sheet delivery table 26 is further slightly lowered so that the space 31 of V-shape is formed in the rear end portion of the sheets 6 by the insertion of the blade 13 and the shutter bar unit 12 that has been on the stand-by position is moved and inserted into this space 31, as shown in FIG. 4(*c*), to thereby provisionally support the sheets 6.

Then, as shown in FIG. 4(*d*), the blade 13 is retreated to the stand-by position so that the entire portion of the sheets 6 including their rear end portion is supported by the shutter bar unit 12. The sheet delivery table 26 is lowered to stop at the lowermost position, and the stacked sheets 6 below the shutter bar unit 12 are discharged outside together with the pallet 4.

Thereafter, a new pallet 4 is placed on the sheet delivery table 26 to be lifted to a predetermined height to stop there. Then, the sheet stopper 32 is operated to regulate the rear ends of the sheets 6 and then the shutter bar unit 12 is again retreated to the stand-by position, as shown in FIG. 4(*e*).

Thus, as shown in FIG. 4(*f*), the sheets 6 that have been provisionally supported by the shutter bar unit 12 are completely placed on the new pallet 4. Thereafter, while the lowering of the sheet delivery table 26 is being controlled corresponding to the thickness of the stacked sheets 6, the subsequently conveyed printed sheets 6 are stacked on the pallet 4. The same sequential steps are repeated and stacking by the continuous stacking system can be carried out.

According to the present first embodiment constructed and operated as described above, such functions and effects as mentioned next can be obtained:

(1) As the shutter bar unit 12 is inserted between the stacked sheets 6 and the subsequent sheets 6 of which rear ends are lifted and supported by the blade 13, such a phenomenon that the falling sheets 6 are crushed from their rear ends by the shutter bar unit 12, as has been a problem in the prior art, can be avoided.

(2) As the shutter bar unit 12, being formed having the rollers 29 supported by the bearings 28, is inserted between the stacked sheets 6 and the subsequent sheets 6 of which rear ends are lifted and supported by the blade 13, the insertion of the shutter bar unit 12 can be carried out with less resistance.

(3) By the above (1) and (2), occurrence of spoilage can be eliminated and the dangerous work to remove the spoilage becomes unnecessary.

(4) Sheet stacking quality (accuracy of sheet jogging) can be largely enhanced.

(5) As the insertion of the shutter bar unit 12 can be done stably while maintaining the usual printing velocity (e.g., no need to reduce printing velocity), the productivity can be remarkably enhanced.

(6) A highly skilled operator is not required.

Figure 5:
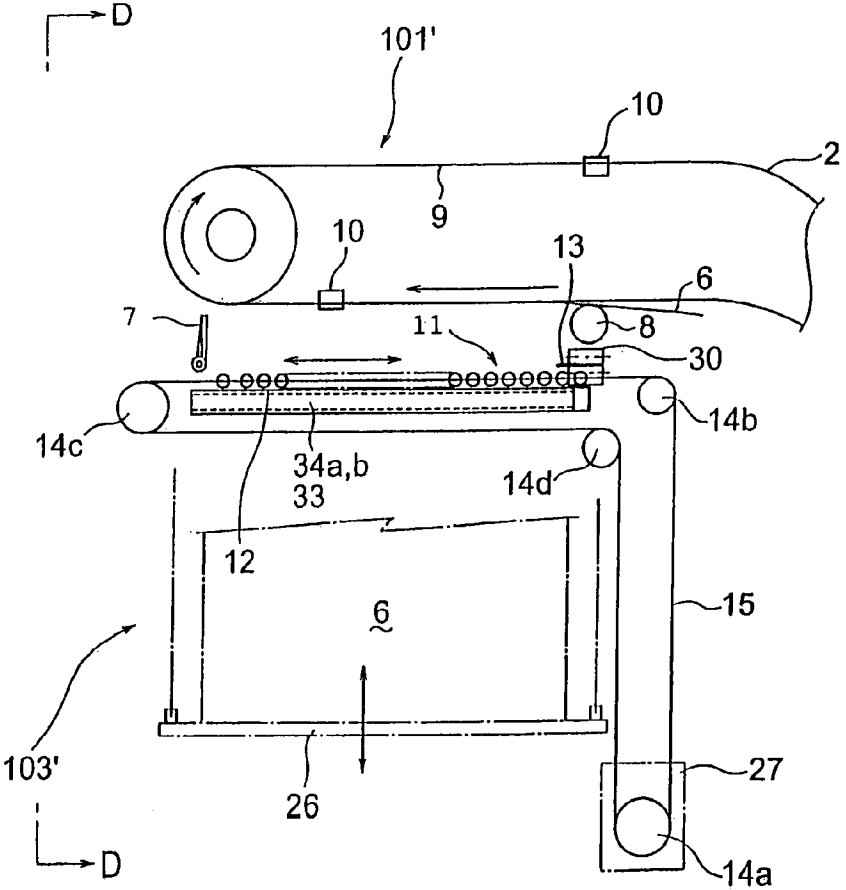
FIG. 5 is a schematic construction explanatory side view of main portions of a sheet delivery device of a sheet-fed press of a second embodiment according to the present invention.
Figure 6:
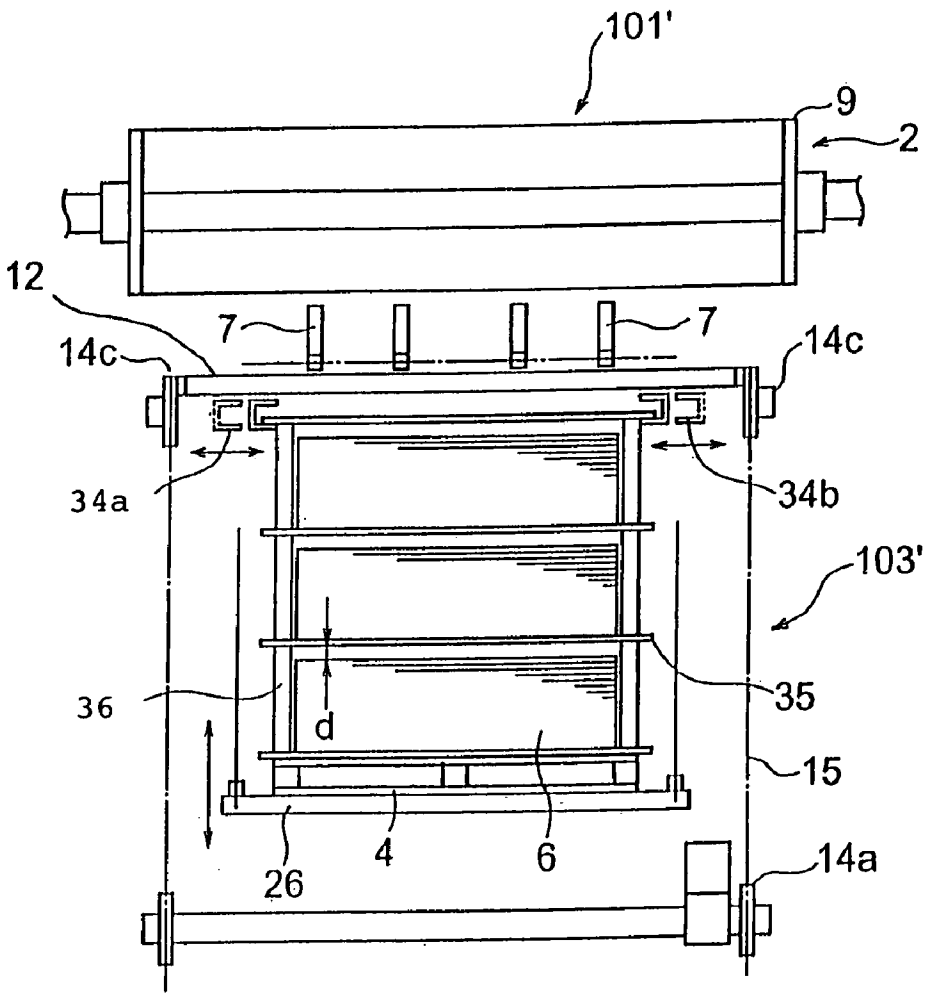
FIG. 6 is a view seen from arrows D—D of FIG. 5.

Next, a sheet delivery device of a sheet-fed press of a second embodiment according to the present invention will be described with reference to FIGS. 5 and 6, wherein the above described FIGS. 7 and 8 also will be referenced for description of the general constructional aspect and the common portions of the first embodiment described with respect to FIGS. 1 to 4 will be also referenced. FIG. 5 is a schematic construction explanatory side view of main portions of the sheet delivery device of the present second embodiment. FIG. 6 is a view seen from arrows D—D of FIG. 5.

In the present description of the sheet delivery device of the second embodiment, the same parts and components as those of the devices of the prior art and the first embodiment are designated with the same reference numerals and description thereon will be omitted. Also, the basic sequential functions of the sheet delivery device until the printed sheets are conveyed above the sheet stacker to fall down thereon are the same as those of the prior art device and those points different from the devices of the prior art and the first embodiment will be mainly described below.

The present second embodiment is constructed such that the sheet stacking system can be freely selected by switchover between the continuous stacking system and the divided stacking system and comprises, in addition to the substantially same shutter device 11 as the prior art device, a plate receiving device 33 that is substantially the same as the prior art device as well as comprises a sheet separating device comprising the same blade 13 and the blade moving device 30 as in the device of the first embodiment both positioned above a sheet stacker 103' of a sheet delivery device 101'.

While the basic construction and function of the shutter device 11 and the plate receiving device 33 are substantially the same as those of the devices of the first embodiment and the prior art, as a different point from the first embodiment and the prior art, the two rails 34*a*, 34*b* of the plate receiving device 33 are provided closely to a lower surface plane of the shutter bar unit 12 at the operation position and in parallel to the sheet conveying direction of the sheet conveyor 2 above both sides of the sheet delivery table 26, pallet 4, partition plate 35 and stacked sheets 6 and are constructed to be back and forth movable to a center of the sheet delivery table 26 so that a distance between the rails 34*a*, 34*b* is changeable. Also, the shutter bar unit 12 and the rails 34*a*, 34*b* as a guide for insertion of the partition plate are constructed so as to avoid their mutual interference. For example, as shown in FIG. 5, the rails 34*a*, 34*b* are provided on the inner side of the loop of the endless chains 15 to which the shutter bar unit 12 is fitted for movement.

In the sheet delivery device 101' of a sheet-fed press of the present second embodiment constructed as described above, while the sequential functions as a sheet delivery device to convey the printed sheets 6 to fall down on the sheet delivery device are basically the same as those of the prior art device as already described, what is largely different from the functions of the prior art device is as follows:

That is, in the case where the sheets 6 are stacked by the continuous stacking system, the function and effect of the blade 13 and the shutter bar unit 12 that have not been seen in the prior art device are the same as those of the above-mentioned first embodiment.

In addition to the above, in case where the sheets 6 are stacked by the divided stacking system in the present second embodiment, when the sheets 6 are stacked in the number of sheets predetermined for each of the partition plates 35, like in the continuous stacking system in the first embodiment, the blade 13 is inserted immediately before the subsequent sheets 6 fall down and the shutter bar unit 12 is inserted into the operation position. Thereby, the printed sheets 6 already stacked on the sheet delivery table 26 and the subsequently conveyed printed sheets 6 are separated from each other into the lower portion and the upper portion, respectively. Thereafter, the subsequent sheets 6 are provisionally received by the shutter bar unit 12 at the operation position.

Then, in the above-mentioned state, the sheet delivery table 26 is lowered to thereby form a gap above the stacked sheets 6 and a new partition plate 35 is inserted into this gap by the rails 34*a*, 34*b*. Like in the prior art case, the blocks 36 are put in between the four corners of the new partition plate 35 and those of the previous partition plate 35 and the sheet delivery table 26 is lifted so that the new partition plate 35 is completely supported to the previous partition plate 35 by the blocks 36 and then the rails 34*a*, 34*b* are retreated outside in the width direction of the sheet conveyor 2 to stay at their stand-by positions. The sheet stopper 32 is operated to regulate the rear ends of the sheets 6 and the shutter bar unit 12 is retreated so that the provisionally received sheets 6 thereon are placed on the new partition plate 35. While the sheet stopper 32 is not shown in FIGS. 5 and 6, it is the same as shown in FIG. 4. Thereafter, while the lowering of the sheet delivery table 26 is likewise controlled, the above-mentioned operations are repeated and bundles of the sheets 6, each bundle having a predetermined number of sheets, are formed.

When the total of the stacked sheets 6 reaches the limited number of sheets per the pallet 4, the same operations as those of the continuous stacking system are carried out, the stacked sheets 6 together with the pallet 4 and the partition plates 35 are discharged outside and a new vacant pallet 4 for replacement is placed on the sheet delivery table 26. While the same steps to operate the sheet delivery table 26 are being carried out like in the continuous stacking system, the step that the shutter bar unit 12 at the operation position provisionally receives the sheets 6 is also carried out like in the first embodiment.

According to the present second embodiment constructed and operated as described above, such functions and effects as mentioned next can be obtained:

(1) By selecting either the continuous stacking system or the divided stacking system, both systems can be quickly and easily employed by switch-over.

(2) As the shutter bar unit 12 is inserted after the rear end portion of the falling sheets 6 is lifted and supported by the blade 13 and the partition plate 35 can be inserted below the shutter bar unit 12, the insertion of the partition plate 35 can be done at an arbitrary timing relative to the stacked sheets 6 to be delivered and the subsequently falling sheets 6. Also, the phenomenon of crushing the falling sheets 6 can be avoided.

(3) Occurrence of spoilage is eliminated and the dangerous work to remove the crushed sheets becomes unnecessary.

(4) While the printing velocity is maintained, the insertion of the partition plate 35 can be done and there is no worry that the printing quality and the productivity are deteriorated.

(5) A highly skilled operator is not required for insertion of the partition plate, etc.

In the above, while the present invention has been described based on the embodiments as illustrated, the present invention is not limited to the described embodiments but, as a matter of course, may be added with various modifications in the concrete structure within the scope of the appended claims.

For example, the front end shape of the blade 13 and the blade moving device 30 can be variously formed differently from the illustrated types. Also, the insertion positions or the operation positions of the blade 13 and the shutter bar unit 12 may be on the front end side of the falling sheets 6 and in this case, the stand-by position of the shutter bar unit 12 can be arranged above the sheet delivery device as an overhead type.

What is claimed is:

1. A sheet delivery device for a sheet-fed press in which printed sheets, conveyed by a sheet conveyor in a sheet moving direction, are sequentially stacked on a pallet, said sheet delivery device comprising:

a sheet separating device operable to create a separation between the sequentially stacked printed sheets and subsequently conveyed printed sheets by temporarily receiving an end portion of the subsequently conveyed printed sheets; and a shutter device arranged to be inserted into the separation between the sequentially stacked printed sheets and the subsequently conveyed printed sheets created by said sheet separating device so as to temporarily receive printed sheets conveyed by the sheet conveyor for enabling replacement of a filled pallet with a vacant pallet, wherein said shutter device comprises:

endless conveying members disposed in a spaced-apart, parallel relation to be disposed on both sides of the sequentially stacked printed sheets, and arranged to be movable in the sheet conveying direction of the sheet conveyor; and a shutter bar unit connected to and spanning between respectively opposing portions of said endless conveying members, wherein said endless conveying members are operable to move said shutter bar unit between an operation position, in which said shutter bar unit is inserted into the separation between the sequentially stacked printed sheets and the subsequently conveyed printed sheets created by said sheet separating device, and a standby position in which said shutter bar unit is not disposed in the separation between the sequentially stacked printed sheets and the subsequently conveyed printed sheets created by said sheet separating device and allows the subsequently printed sheets to drop through a space between said endless conveying members and onto the pallet.

2. The sheet delivery device of claim 1, wherein said endless conveying members comprise endless chains.

3. The sheet delivery device of claim 2, wherein said shutter bar unit further comprises:

a plurality of roller attachments supported by said endless chains and adjacently arranged side-by-side in the sheet conveying direction of the sheet conveyor; and a plurality of rollers arranged such that each end of each of said plurality of rollers is attached, via a bearing, to one of said plurality of roller attachments.

4. The sheet delivery device of claim 3, further comprising:

a sheet delivery table arranged to support the pallet and operable to incrementally move between a raised position and a lowered position so as to maintain a specified distance between the sheet conveyor and a most recently sequentially stacked printed sheet.

5. The sheet delivery device of claim 1, wherein said endless conveying members comprise endless belts.

6. The sheet delivery device of claim 5, wherein said shutter bar unit further comprises:

a plurality of roller attachments supported by said endless belts and adjacently arranged side-by-side in the sheet conveying direction of the sheet conveyor; and a plurality of rollers arranged such that each end of each of said plurality of rollers is attached, via a bearing, to one of said plurality of roller attachments.

7. The sheet delivery device of claim 6, further comprising:

a sheet delivery table arranged to support the pallet and operable to incrementally move between a raised position and a lowered position so as to maintain a specified distance between the sheet conveyor and a most recently sequentially stacked printed sheet.

8. The sheet delivery device of claim 1, further comprising:

a sheet delivery table arranged to support the pallet and operable to incrementally move between a raised position and a lowered position so as to maintain a specified distance between the sheet conveyor and a most recently sequentially stacked printed sheet.

9. The sheet delivery device of claim 1, further comprising a plate receiving device comprising movable rails arranged to be disposed on both sides of the sequentially stacked printed sheets and in a spaced-apart parallel relation to the sheet conveying direction of the sheet conveyor, and arranged to be disposed below said shutter bar unit when said shutter bar unit is arranged in the operation position, wherein said movable rails are operable to move between a receive position for receiving a sheet separator for permanently separating the sequentially stacked printed sheets, in which said movable rails are arranged to receive and support the sheet separator, and a deliver position for delivering the sheet separator, in which said movable rails are operable to move apart in a direction orthogonal to the sheet moving direction of the sheet conveyor so as to increase the distance between said moving rails and release the sheet separator.

10. The sheet delivery device of claim 1, wherein said sheet separating device further comprises a belt-like blade operable to move above and across an entire width of the sequentially stacked sheets in a direction orthogonal to the sheet moving direction of the sheet conveyor for temporarily receiving and supporting the end portion of the printed sheets subsequently conveyed and dropped by the sheet conveyor for creating the separation between the sequentially stacked printed sheets and the subsequently conveyed printed sheets.

11. A sheet delivery device for a sheet-fed press in which printed sheets are sequentially stacked on a removable pallet arranged on a sheet delivery table, said sheet delivery device comprising:

a sheet conveyor operable to continuously and sequentially stack the sheets by conveying the printed sheets in a sheet moving direction and dropping the printed sheets into the sequential stack;

a sheet separating device for creating a separation between the sequentially stacked printed sheets and subsequently conveyed printed sheets, said sheet separating device comprising:

a belt-like blade arranged to move between:

an operation position, in which said belt-like blade is arranged above and across an entire width of the sequentially stacked printed sheets in a direction orthogonal to the sheet moving direction of said sheet conveyor for temporarily receiving and supporting an end portion of the printed sheets subsequently conveyed and dropped by said sheet conveyor, for creating the separation between the sequentially stacked printed sheets and the subsequently conveyed printed sheets, and a standby position, in which said belt-like blade is not arranged above and across the entire width of the sequentially stacked printed sheets, wherein said sheet separating device is operable to move said belt-like blade into the operation position upon a determination that the removable pallet is a filled pallet; and a shutter device arranged to be inserted into the separation between the sequentially stacked printed sheets and the subsequently conveyed printed sheets created by said sheet separating device, when said belt-like blade is arranged in the operating position, so as to temporarily receive printed sheets conveyed by said sheet conveyor.

12. The sheet delivery device of claim 11, wherein said endless conveying members comprise endless chains.

13. The sheet delivery device of claim 12, wherein said shutter bar unit further comprises:

a plurality of roller attachments supported by said endless chains and adjacently arranged side-by-side in the sheet conveying direction of the sheet conveyor; and a plurality of rollers arranged such that each end of each of said plurality of rollers is attached, via a bearing, to one of said plurality of roller attachments.

14. The sheet delivery device of claim 11, wherein said endless conveying members comprise endless belts.

15. The sheet delivery device of claim 14, wherein said shutter bar unit further comprises:

a plurality of roller attachments supported by said endless belts and adjacently arranged side-by-side in the sheet conveying direction of the sheet conveyor; and a plurality of rollers arranged such that each end of each of said plurality of rollers is attached, via a bearing, to one of said plurality of roller attachments.

16. The sheet delivery device of claim 11, further comprising a plate receiving device comprising movable rails arranged in a spaced-apart parallel relation to be disposed on both sides of the sequentially stacked printed sheets and in parallel to the sheet conveying direction of the sheet conveyor, and arranged to be disposed below said shutter bar unit when said shutter bar unit is arranged in the operation position, wherein said movable rails are operable to move between a receive position for receiving a sheet separator for permanently separating the sequentially stacked printed sheets, in which said movable rails are arranged to receive and support the sheet separator, and a deliver position for delivering the sheet separator, in which said movable rails are operable to move apart in a direction orthogonal to the sheet moving direction of the sheet conveyor so as to increase the distance between said moving rails and release the sheet separator.

17. The sheet deliver device of claim 11, wherein said shutter device further comprises:

endless conveying members disposed in a spaced-apart, parallel relation to be disposed on both sides of the sequentially stacked printed sheets, and arranged to be movable in the sheet conveying direction of the sheet conveyor; and a shutter bar unit connected to and spanning between respectively opposing portions of said endless conveying members, wherein said endless conveying members are operable to move said shutter bar unit between an operation position, in which said shutter bar unit is inserted into the separation between the sequentially stacked printed sheets and the subsequently conveyed printed sheets created by said belt-like blade, and a standby position in which said shutter bar unit is not disposed in the separation between the sequentially stacked printed sheets and the subsequently conveyed printed sheets created by said belt-like blade and allows the subsequently printed sheets to drop through a space between said endless conveying members and onto the pallet.

* * * * *